US011688363B2

(12) United States Patent
Yang et al.

(10) Patent No.: US 11,688,363 B2
(45) Date of Patent: Jun. 27, 2023

(54) REFERENCE PIXEL STRESSING FOR BURN-IN COMPENSATION SYSTEMS AND METHODS

(71) Applicant: Apple Inc., Cupertino, CA (US)

(72) Inventors: Maofeng Yang, Santa Clara, CA (US); Jiayi Jin, Redwood City, CA (US); David A. Doyle, Cupertino, CA (US); Yifan Zhang, San Carlos, CA (US); Weijun Yao, Saratoga, CA (US); Jiye Lee, Mountain View, CA (US); Tae-Wook Koh, San Jose, CA (US); Mathew K. Mathai, San Jose, CA (US); Chuang Qian, San Jose, CA (US); Tsung-Ting Tsai, San Jose, CA (US); James P. Landry, Cupertino, CA (US); Kiran S. Pillai, San Bruno, CA (US); Injae Hwang, Cupertino, CA (US); Yongjun Li, Fremont, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/376,125

(22) Filed: Jul. 14, 2021

(65) Prior Publication Data

US 2022/0093059 A1 Mar. 24, 2022

Related U.S. Application Data

(60) Provisional application No. 63/082,833, filed on Sep. 24, 2020.

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/046* (2013.01); *G09G 2330/028* (2013.01); *G09G 2360/145* (2013.01)

(58) Field of Classification Search
None
See application file for complete search history.

(56) References Cited

U.S. PATENT DOCUMENTS

2010/0053045 A1* 3/2010 Fish ..... G09G 3/3233 345/82
2015/0161942 A1* 6/2015 Chaji ..... G09G 3/3225 345/78

(Continued)

*Primary Examiner* — Kenneth Bukowski
(74) *Attorney, Agent, or Firm* — Fletcher Yoder P.C.

(57) ABSTRACT

An electronic device may include an electronic display including display pixels to display an image based on compensated image data. The electronic display may also include a stressed reference pixel to exhibit burn-in related aging in response to one or more stress sessions and a non-stressed reference pixel configured to not undergo the one or more stress sessions. Additionally, the electronic device may include image processing circuitry to determine a panel-specific aging profile based on a comparison between one or more properties of the stressed reference pixel and the one or more properties of the non-stressed reference pixel. The image processing circuitry may also generate one or more gain maps based on the panel-specific aging profile and generate the compensated image data by applying the one or more gain maps to input image data.

18 Claims, 9 Drawing Sheets

(56) References Cited

U.S. PATENT DOCUMENTS

| | | | | |
|---|---|---|---|---|
| 2016/0307498 | A1* | 10/2016 | Chaji | G09G 3/3291 |
| 2018/0247588 | A1* | 8/2018 | Lee | G09G 3/3225 |
| 2018/0286356 | A1 | 10/2018 | Jiang et al. | |
| 2018/0350296 | A1* | 12/2018 | Thompson | G06F 3/0673 |
| 2018/0366060 | A1 | 12/2018 | Chaji et al. | |
| 2019/0080666 | A1* | 3/2019 | Chappalli | G09G 5/02 |
| 2019/0237026 | A1 | 8/2019 | Chaji et al. | |

* cited by examiner

REFERENCE PIXEL STRESSING FOR BURN-IN COMPENSATION SYSTEMS AND METHODS

CROSS-REFERENCE TO RELATED APPLICATIONS

This application claims priority to and the benefit of U.S. Provisional Application No. 63/082,833, entitled "Reference Pixel Stressing for Burn-In Compensation Systems and Methods," filed Sep. 24, 2020, the disclosure of which is incorporated by reference in its entirety for all purposes.

SUMMARY

This disclosure relates to image data processing and compensating for pixel burn-in/aging of pixels of an electronic display.

Numerous electronic devices—including televisions, portable phones, computers, wearable devices, vehicle dashboards, virtual-reality glasses, and more—display images on an electronic display. As electronic displays gain increasingly higher resolutions and dynamic ranges, they may also become increasingly more susceptible to image display artifacts due to pixel burn-in. This disclosure relates to identifying and compensating for burn-in and/or aging artifacts on an electronic display. Burn-in is a phenomenon whereby pixels degrade over time owing to various factors, including the different amounts of light that different pixels may emit over time. For example, if certain pixels are used more frequently than others, or used in situations that are more likely cause undue aging, such as high temperature environments, those pixels may exhibit more aging than other pixels. As a result, those pixels may gradually emit less light when given the same driving current or voltage values, effectively becoming darker than other pixels when given a signal for the same brightness level. As such, without compensation, burn-in artifacts may be visibly perceived due to non-uniform sub-pixel aging.

In some embodiments, circuitry and/or software may monitor or model a burn-in effect that would be likely to occur in the electronic display as a result of the image data that is sent to the electronic display. For example, statistics surrounding the utilization of the pixels of the electronic display and/or environmental conditions (e.g., temperature) during operation of the pixels may be analyzed and tracked (e.g., via a burn-in history map). The statistics may then be used to derive gain maps for adjusting image data before it is sent to the electronic display to reduce or eliminate the appearance of burn-in artifacts on the electronic display.

However, the pixels of different display panels may exhibit different aging rates due to environmental factors, manufacturing tolerances, case-specific utilization, etc. As such, embodiments of the present disclosure include reference pixels that may be stressed during the life of the electronic display to generate a panel-specific aging profile. The reference pixels may be stressed and voltage shift measured to determine the panel-specific aging profile. The panel-specific aging profile may correlate burn-in related aging to pixel efficiency drop and changes in luminance output that is specific to the individual electronic display. By using a panel-specific aging profile, the electronic display may have reduced perceivable artifacts and/or may have increased peak brightness capabilities.

Additionally or alternatively, the electronic device may stress the reference pixels and measure the luminance output of the reference pixels via a luminance sensor (e.g., photodiode, photoresistor, etc.). The measured luminance output of the reference pixels may provide data to generate a panel-specific luminance profile which may be used instead of, in conjunction with, or as part of the panel-specific aging profile. For example, the luminance output of the reference pixels stressed during the life of the electronic display may be measured at given image data values to give valuable insight into the how pixels of the particular panel age over time and through operation.

Burn-in gain maps may be derived to compensate for the burn-in effects based on the tracked operation of the active area pixels using the panel-specific aging profile. In this way, the pixels of the electronic display that have suffered the greatest amount of aging will appear to be equally as bright as the pixels that have suffered the least amount of aging. As such, perceivable burn-in artifacts on the electronic display may be reduced or eliminated.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
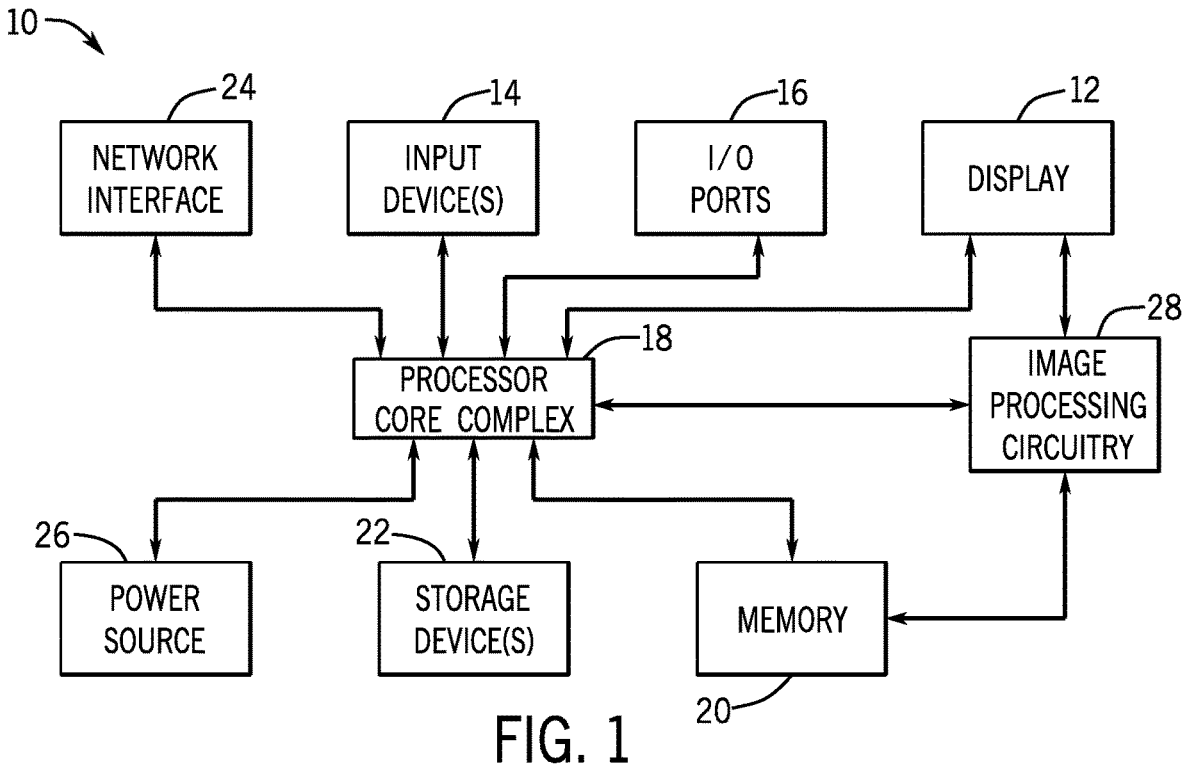
FIG. 1 is a block diagram of an electronic device including an electronic display, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Numerous electronic devices—including televisions, portable phones, computers, wearable devices, vehicle dashboards, virtual-reality glasses, and more—display images on an electronic display. As electronic displays gain increasingly higher resolutions and dynamic ranges, they may also become increasingly more susceptible to image display artifacts due to pixel burn-in. Burn-in is a phenomenon whereby pixels degrade over time owing to the different amount of light that different pixels emit over time. In other words, pixels may age at different rates depending on their relative utilization. For example, pixels used more than others may age more quickly, and thus may gradually emit less light when given the same amount of driving current or voltage. This may produce undesirable burn-in image artifacts on the electronic display.

Circuitry and/or software may monitor or model a burn-in effect that would be likely to occur in the electronic display as a result of the image data that is sent to the electronic display. For example, statistics surrounding the utilization of the pixels of the electronic display and/or environmental conditions (e.g., temperature) during operation of the pixels may be analyzed and tracked (e.g., via a burn-in history map) and used to derive gain maps for adjusting image data, before it is sent to the electronic display, to reduce or eliminate the appearance of burn-in artifacts on the electronic display. However, the pixels of different display panels may exhibit different aging rates due to environmental factors, manufacturing tolerances, case-specific utilization, etc. As such, to improve compensation accuracy, embodiments of the present disclosure include reference pixels that may be stressed and monitored during the life of the electronic display to generate a panel-specific aging profile.

In some embodiments, the reference pixels may be stressed and voltage shift measured to determine the panel-specific aging profile. The panel-specific aging profile may correlate burn-in related aging to a pixel efficiency drop and a change in luminance output that is specific to the individual electronic display. By using a panel-specific aging profile, the electronic display may have reduced perceivable artifacts and/or may have increased peak brightness capabilities.

Additionally or alternatively, the electronic device may stress the reference pixels and measure the luminance output of the reference pixels via a luminance sensor such as a photodiode, photoresistor, or other luminance measuring technique. The measured luminance output of the reference pixels may provide data to generate a panel-specific luminance profile which may be used instead of, in conjunction with, or as part of the panel-specific aging profile. For example, the luminance output of the reference pixels stressed during the life of the electronic display may be measured at given image data values to give valuable insight into the how pixels of the particular panel age over time and through operation.

Burn-in gain maps may be derived based on the tracked operation of the active area pixels and the panel-specific aging profile to compensate image data for the burn-in effects. In this way, the pixels of the electronic display that have suffered the greatest amount of aging will appear to be equally as bright as the pixels that have suffered the least amount of aging. As such, perceivable burn-in artifacts on the electronic display may be reduced or eliminated.

To help illustrate, one embodiment of an electronic device 10 that utilizes an electronic display 12 is shown in FIG. 1. As will be described in more detail below, the electronic device 10 may be any suitable electronic device, such as a handheld electronic device, a tablet electronic device, a notebook computer, and the like. Thus, it should be noted that FIG. 1 is merely one example of a particular implementation and is intended to illustrate the types of components that may be present in the electronic device 10.

The electronic device 10 may include one or more electronic displays 12, input devices 14, input/output (I/O) ports 16, a processor core complex 18 having one or more processors or processor cores, local memory 20, a main memory storage device 22, a network interface 24, a power source 26, and image processing circuitry 28. The various components described in FIG. 1 may include hardware elements (e.g., circuitry), software elements (e.g., a tangible, non-transitory computer-readable medium storing instructions), or a combination of both hardware and software elements. As should be appreciated, the various components may be combined into fewer components or separated into additional components. For example, the local memory 20 and the main memory storage device 22 may be included in a single component. Additionally, the image processing circuitry 28 (e.g., a graphics processing unit, a display image processing pipeline, etc.) may be included in the processor core complex 18.

The processor core complex 18 may be operably coupled with local memory 20 and the main memory storage device 22. The local memory 20 and/or the main memory storage device 22 may include tangible, non-transitory, computer-readable media that store instructions executable by the processor core complex 18 and/or data to be processed by the processor core complex 18. For example, the local memory 20 may include random access memory (RAM) and the main memory storage device 22 may include read only memory (ROM), rewritable non-volatile memory such as flash memory, hard drives, optical discs, and/or the like.

The processor core complex 18 may execute instructions stored in local memory 20 and/or the main memory storage device 22 to perform operations, such as generating source image data. As such, the processor core complex 18 may include one or more general purpose microprocessors, one or more application specific processors (ASICs), one or more field programmable logic arrays (FPGAs), or any combination thereof.

The network interface 24 may connect the electronic device 10 to a personal area network (PAN), such as a Bluetooth network, a local area network (LAN), such as an 802.11x Wi-Fi network, and/or a wide area network (WAN), such as a 4G or LTE cellular network. In this manner, the network interface 24 may enable the electronic device 10 to transmit image data to a network and/or receive image data from the network.

The power source 26 may provide electrical power to operate the processor core complex 18 and/or other components in the electronic device 10. Thus, the power source 26 may include any suitable source of energy, such as a rechargeable lithium polymer (Li-poly) battery and/or an alternating current (AC) power converter.

The I/O ports 16 may enable the electronic device 10 to interface with various other electronic devices. The input devices 14 may enable a user to interact with the electronic device 10. For example, the input devices 14 may include buttons, keyboards, mice, trackpads, and the like. Additionally or alternatively, the electronic display 12 may include touch sensing components that enable user inputs to the electronic device 10 by detecting occurrence and/or position of an object touching its screen (e.g., surface of the electronic display 12).

The electronic display 12 may display a graphical user interface (GUI) of an operating system, an application interface, text, a still image, or video content. To facilitate displaying images, the electronic display 12 may include a display panel with one or more display pixels. Additionally, each display pixel may include one or more sub-pixels, which each control the luminance of a color component (e.g., red, green, or blue). As used herein, a display pixel may refer to a collection of sub-pixels (e.g., red, green, and blue subpixels) or may refer to a single sub-pixel.

As described above, the electronic display 12 may display an image by controlling the luminance of the sub-pixels based at least in part on corresponding image data. In some embodiments, the image data may be received from another electronic device, for example, via the network interface 24 and/or the I/O ports 16. Additionally or alternatively, the image data may be generated by the processor core complex 18 and/or the image processing circuitry 28. Moreover, in some embodiments, the electronic device 10 may include multiple electronic displays 12 and/or may perform image processing (e.g., via the image processing circuitry 28) for one or more external electronic displays 12, such as connected via the network interface 24 and/or the I/O ports 16.

Figure 2:
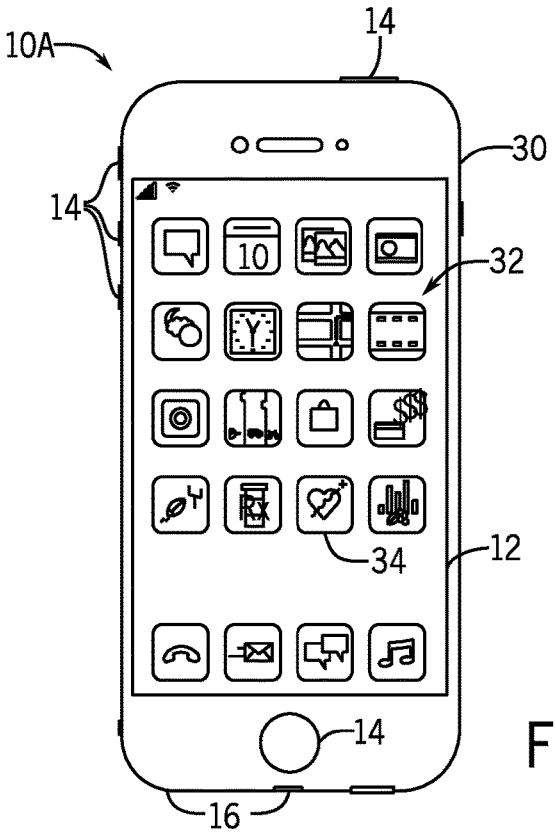
FIG. 2 is an example of the electronic device of FIG. 1, in accordance with an embodiment.

The electronic device 10 may be any suitable electronic device. To help illustrate, one example of a suitable electronic device 10, specifically a handheld device 10A, is shown in FIG. 2. In some embodiments, the handheld device 10A may be a portable phone, a media player, a personal data organizer, a handheld game platform, and/or the like. For example, the handheld device 10A may be a smart phone, such as any iPhone® model available from Apple Inc.

The handheld device 10A may include an enclosure 30 (e.g., housing) to, for example, protect interior components from physical damage and/or shield them from electromagnetic interference. Additionally, the enclosure 30 may surround, at least partially, the electronic display 12. In the depicted embodiment, the electronic display 12 is displaying a graphical user interface (GUI) 32 having an array of icons 34. By way of example, when an icon 34 is selected either by an input device 14 or a touch-sensing component of the electronic display 12, an application program may launch.

Furthermore, input devices 14 may be provided through openings in the enclosure 30. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. Moreover, the I/O ports 16 may also open through the enclosure 30.

Figure 3:
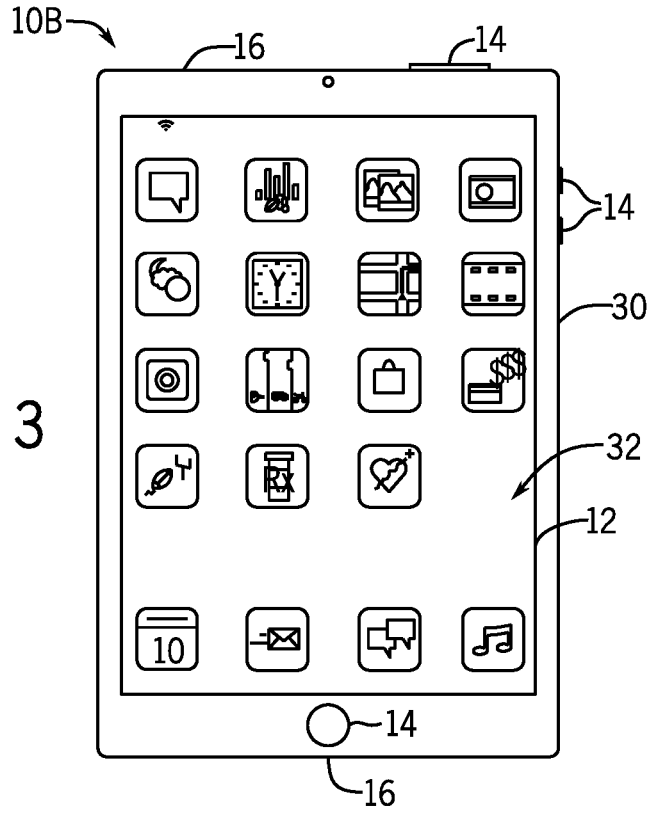
FIG. 3 is another example of the electronic device of FIG. 1, in accordance with an embodiment.
Figure 4:
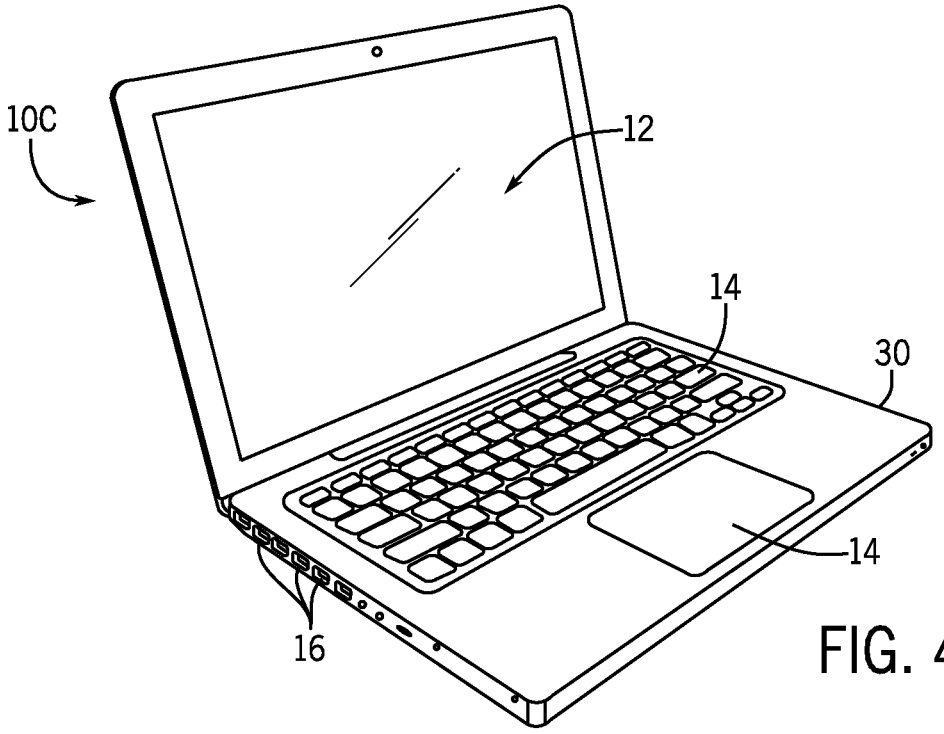
FIG. 4 is another example of the electronic device of FIG. 1, in accordance with an embodiment.
Figure 5:
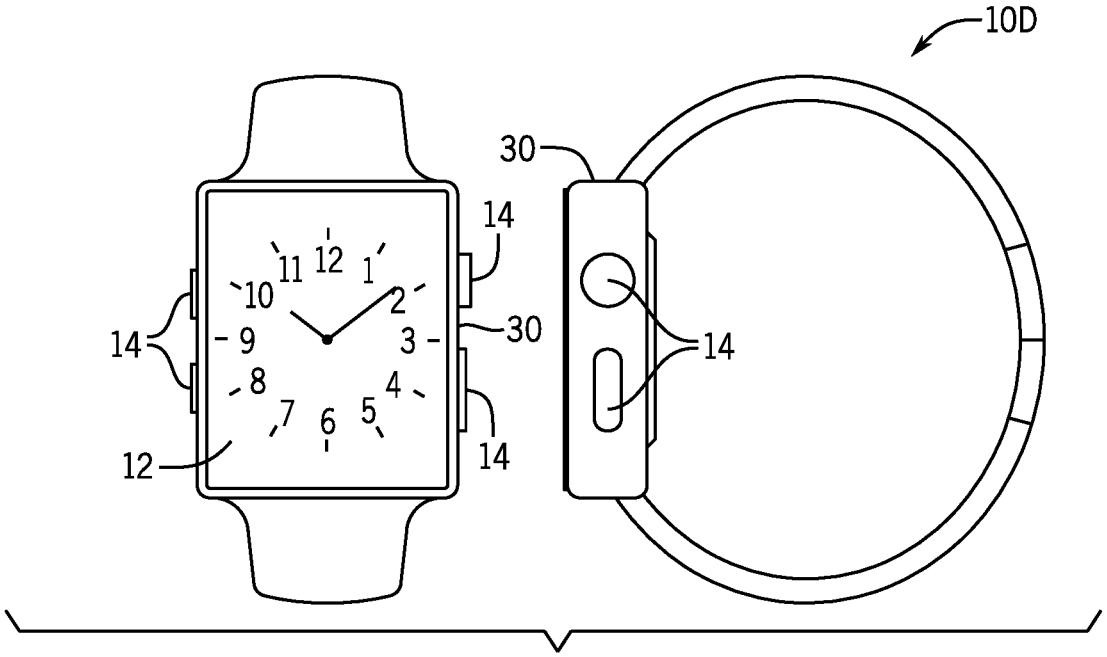
FIG. 5 is another example of the electronic device of FIG. 1, in accordance with an embodiment.

Another example of a suitable electronic device 10, specifically a tablet device 10B, is shown in FIG. 3. For illustrative purposes, the tablet device 10B may be any iPad® model available from Apple Inc. A further example of a suitable electronic device 10, specifically a computer 10C, is shown in FIG. 4. For illustrative purposes, the computer 10C may be any MacBook® or iMac® model available from Apple Inc. Another example of a suitable electronic device 10, specifically a watch 10D, is shown in FIG. 5. For illustrative purposes, the watch 10D may be any Apple Watch® model available from Apple Inc. As depicted, the tablet device 10B, the computer 10C, and the watch 10D each also includes an electronic display 12, input devices 14, I/O ports 16, and an enclosure 30.

The electronic display 12 may display images based at least in part on image data. Before being used to display a corresponding image on the electronic display 12, the image data may be processed, for example, via the image processing circuitry 28. The image processing circuitry 28 may include a display pipeline, memory-to-memory scaler and rotator (MSR) circuitry, or additional hardware or software for processing image data. As should be appreciated, the present techniques may be implemented in standalone circuitry, software, and/or firmware.

Figure 6:
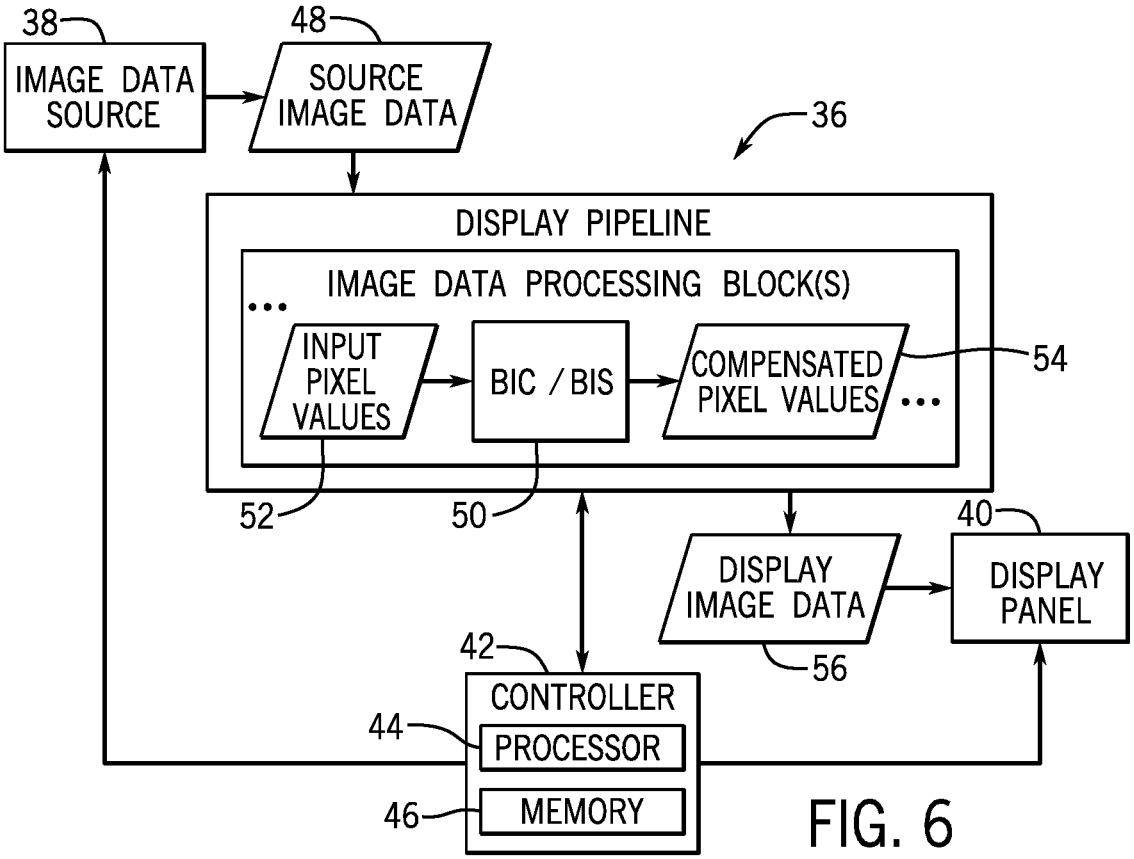
FIG. 6 is a block diagram of a portion of the electronic device of FIG. 1 including a display pipeline having a burn-in compensation (BIC) and burn-in statistics (BIS) collection block, in accordance with an embodiment.

As described above, the image data may be processed to compensate for an estimated amount of burn-in related aging to reduce or eliminate perceivable artifacts due to pixel aging. To help illustrate, a portion of the electronic device 10, including a display pipeline 36, is shown in FIG. 6. In some embodiments, the display pipeline 36 may be implemented by circuitry in the electronic device 10, circuitry in the electronic display 12, or a combination thereof. For example, the display pipeline 36 may be included in the processor core complex 18, the image processing circuitry 28, a timing controller (TCON) in the electronic display 12, or any combination thereof. As should be appreciated, although image processing is discussed herein as being performed via the display pipeline 36, embodiments may include hardware, software, or firmware components that carry out the present techniques as part of, separate from, and/or parallel with a display pipeline, MSR circuitry, or other image processing circuitry.

The electronic device 10 may also include an image data source 38, a display panel 40, and/or a controller 42 in communication with the display pipeline 36. In some embodiments, the display panel 40 of the electronic display 12 may be a liquid crystal display (LCD), a light emitting diode (LED) display, an organic LED (OLED) display, or any other suitable type of display panel 40. In some embodiments, the controller 42 may control operation of the display pipeline 36, the image data source 38, and/or the display panel 40. To facilitate controlling operation, the controller 42 may include a controller processor 44 and/or controller memory 46. In some embodiments, the controller processor 44 may be included in the processor core complex 18, the image processing circuitry 28, a timing controller in the electronic display 12, a separate processing module, or any combination thereof and execute instructions stored in the controller memory 46. Additionally, in some embodiments, the controller memory 46 may be included in the local memory 20, the main memory storage device 22, a separate tangible, non-transitory, computer readable medium, or any combination thereof.

The display pipeline 36 may receive source image data 48 corresponding to a desired image to be displayed on the electronic display 12 from the image data source 38. The source image data 48 may indicate target characteristics (e.g., pixel data) corresponding to the desired image using any suitable source format, such as an 8-bit fixed point αRGB format, a 10-bit fixed point αRGB format, a signed 16-bit floating point αRGB format, an 8-bit fixed point YCbCr format, a 10-bit fixed point YCbCr format, a 12-bit fixed point YCbCr format, and/or the like. In some embodiments, the image data source 38 may include the processor core complex 18, the image processing circuitry 28, memory 20, a storage device 22, the network interface 24, I/O ports 16, or a combination thereof. Furthermore, the source image data 48 may reside in a linear color space, a gamma-corrected color space, or any other suitable color space. As used herein, pixels or pixel data may refer to a grouping of sub-pixels (e.g., individual color component pixels such as red, green, and blue) or the sub-pixels themselves.

As described above, the display pipeline 36 may operate to process source image data 48 received from the image data source 38. The display pipeline 36 may include one or more image data processing blocks (e.g., circuitry, modules, or processing stages) such as a burn-in compensation (BIC)/burn-in statistics (BIS) block 50. As should be appreciated, multiple other image data processing blocks may also be incorporated into the display pipeline 36 such as a color management block, a dither block, etc. Further, the functions (e.g., operations) performed by the display pipeline 36 may be divided between various image data processing blocks, and while the term "block" is used herein, there may or may not be a logical separation between the image data processing blocks.

The BIC/BIS block 50 may compensate for burn-in to reduce or eliminate the visual effects of burn-in, as well as to collect image statistics about the degree to which burn-in is expected to have occurred on the electronic display 12. As such, the BIC/BIS block 50 may receive input pixel values 52 representative of each of the color components of the source image data 48 and output compensated pixel values 54. As stated above, other image data processing blocks may also be utilized in the display pipeline 36. As such, the input pixel values 52 and/or the compensated pixel values 54 may be processed by other image data processing blocks before and/or after the BIC/BIS block 50. By including the BIC/BIS block 50 in image processing, the resulting display image data 56 output by the display pipeline 36 for display on the display panel 40 may suffer substantially fewer or no burn-in artifacts. After processing, the display pipeline 36 may output the display image data 56 to the display panel 40. Based at least in part on the display image data 56, the display panel 40 may apply analog electrical signals to the display pixels of the electronic display 12 to display one or more corresponding images.

Figure 7:
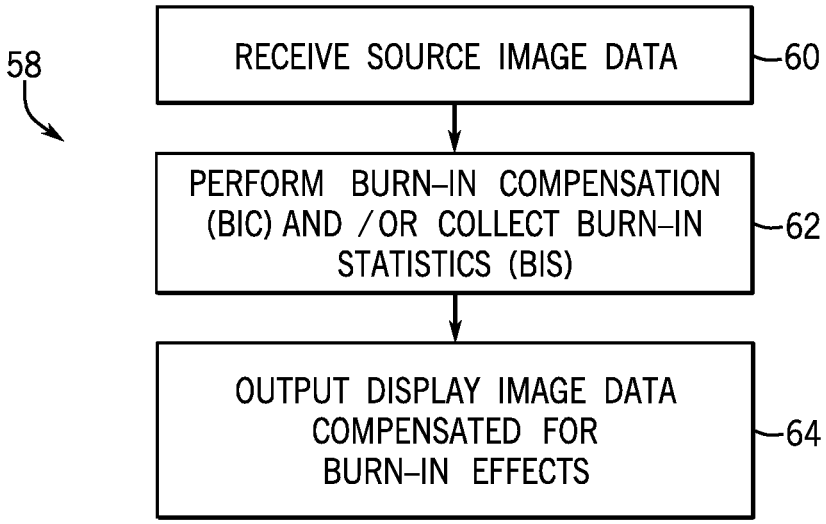
FIG. 7 is a flowchart of an example process for operating the display pipeline of FIG. 6, in accordance with an embodiment.

To help illustrate, FIG. 7 is a flowchart 58 of an example process for operating the display pipeline 36. Generally, the process of the flowchart 58 may include receiving source image data 48 from the image data source 38 or from another portion of the image processing circuitry 28 (process block 60). The display pipeline may also perform burn-in compensation (BIC) and/or collect burn-in statistics (BIS) (process block 62), for example, via the BIC/BIS block 50. The display pipeline may then output the display image data 56, which is compensated for burn-in effects (process block 64). In some embodiments, the process of the flowchart 58 may be implemented based on circuit connections formed in the display pipeline 36. Additionally or alternatively, in some embodiments, the process of the flowchart 58 may be implemented in whole or in part by executing instructions stored in a tangible non-transitory computer-readable medium, such as the controller memory 46, using processing circuitry, such as the controller processor 44.

Figure 8:
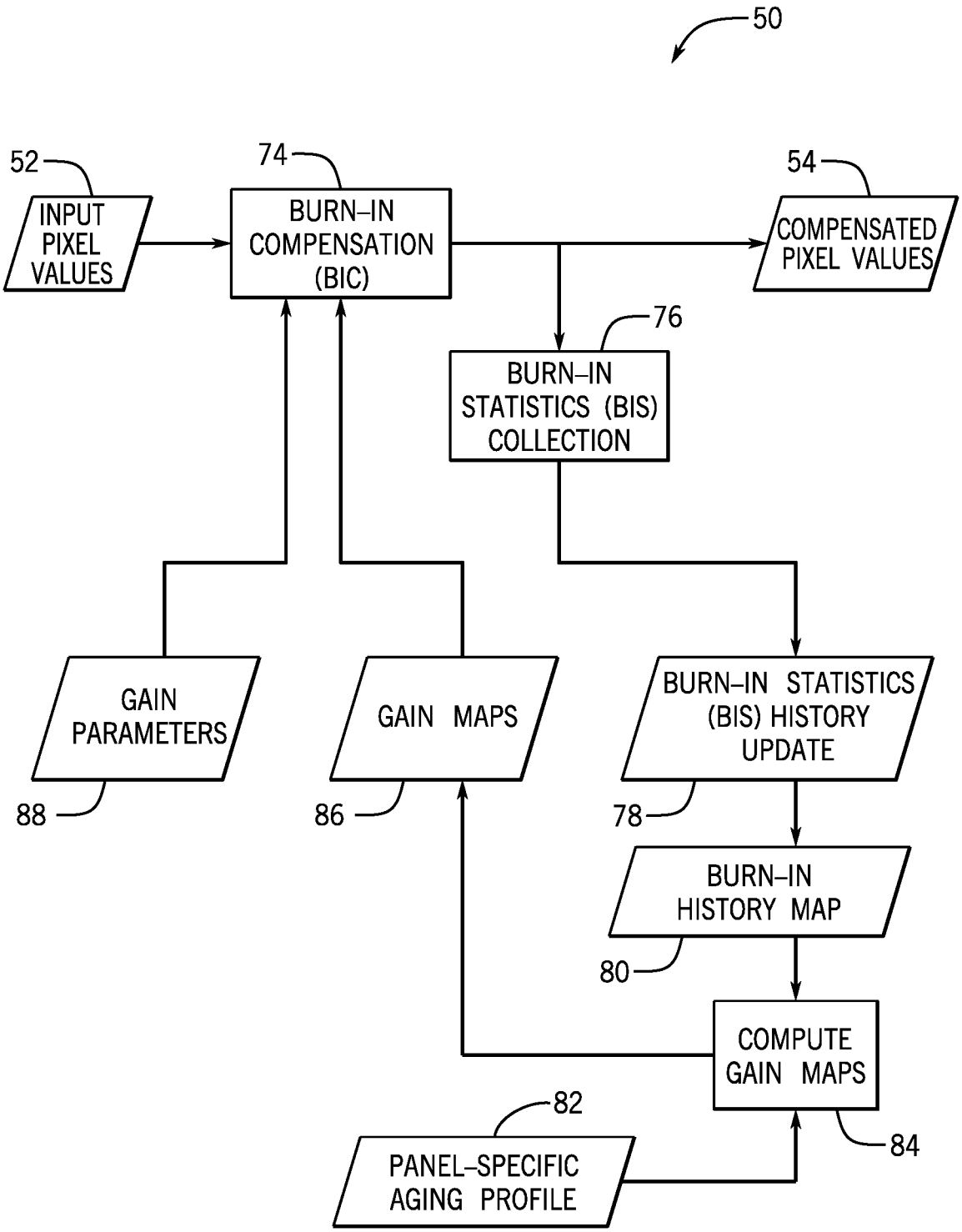
FIG. 8 is a block diagram of the burn-in compensation (BIC) and burn-in statistics (BIS) collection block of FIG. 6, in accordance with an embodiment.

The BIC/BIS block 50 may encompass a BIC sub-block 74 and a BIS collection sub-block 76, as shown in FIG. 8. The BIC sub-block 74 may receive the input pixel values 52 and output the compensated pixel values 54 adjusted for non-uniform pixel aging of the electronic display 12. Additionally, the BIS collection sub-block 76 may analyze all or a portion of the compensated pixel values 54 to generate a BIS history update 78 (i.e., an incremental update) representing an increased amount of pixel aging that is estimated to have occurred since a corresponding previous BIS history update 78. In some embodiments, a burn-in history map 80 may maintained as a cumulative mapping of the estimated burn-in related aging of the display panel 40.

Additionally, a panel-specific aging profile 82 may be maintained to correlate the burn-in history map 80 to changes in luminance for the pixels of the display panel 40. The BIC/BIS block 50 may use the burn-in history map 80 and the panel-specific aging profile 82 in a compute gain maps sub-block 84 to generate gain maps 86 for compensating the input pixel values 52. In some embodiments, the gain maps 86 may be two-dimensional (2D) maps of per-color-component pixel gains. For example, the gain maps 86 may be programmed into 2D lookup tables (LUTs) in the display pipeline 36 for use by the BIC sub-block 74.

Additionally, in some embodiments, the BIC sub-block 74 may utilize gain parameters 88 to account for dynamic and/or global (e.g., affecting the entire, majority, or preset portions of display pixels) factors such as brightness settings, normalizations, etc. As should be appreciated, the gain parameters 88 are non-limiting and additional parameters may also be included in determining the compensated pixel values 54 such as floating or fixed reference values and/or parameters representative of the type of electronic display panel 40. As such, the gain parameters 88 may represent any suitable parameters that the BIC sub-block 74 may use to appropriately adjust the values of and/or apply the gain maps 86 to compensate for burn-in.

Figure 9:
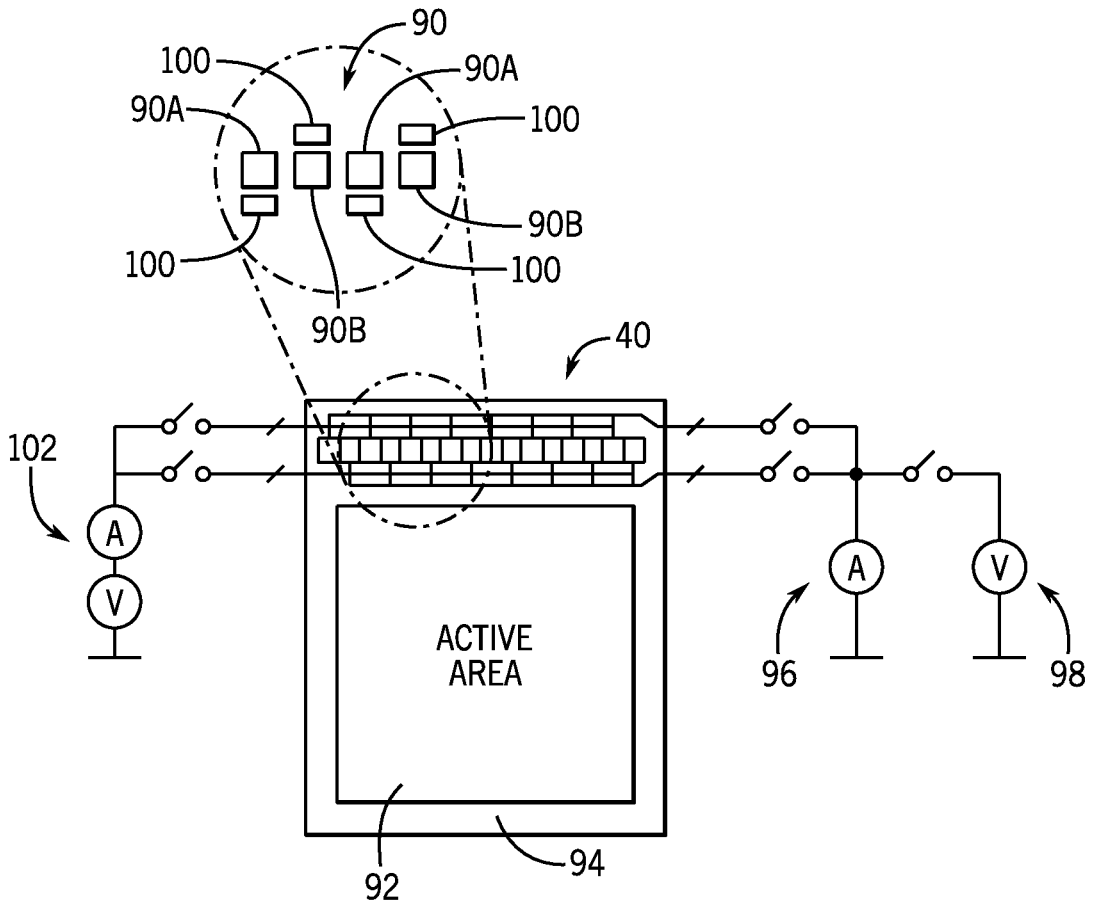
FIG. 9 is a diagrammatic representation of a display panel having reference pixels, in accordance with an embodiment.

As discussed above, the burn-in compensation processing 74 may utilize a panel-specific aging profile 82 to help determine the compensations to the input pixel values 52. In order to generate the panel-specific aging profile 82, the display panel 40 may include one or more reference pixels 90 in addition to the pixels within the active area 92, as shown in FIG. 9. In some embodiments, the reference pixels 90 may be physically, logically, and/or electrically equivalent to pixels within the active area 92 of the display panel 40 to more accurately predict pixel aging for the pixels within the active area 92. The active area 92 may generally correspond to the portion of the electronic display 12 that operationally displays content based on the compensated pixel values 54 and/or is visible to a user.

In order to generate reference data indicative of how the pixels of the display panel 40 exhibit burn-in, some of the reference pixels 90 may be intentionally aged (e.g., subjected to burn-in stress) by activation at known luminance output levels (e.g., 25 percent luminance output, 50 percent luminance output, 75 percent luminance output, or 100 percent luminance output). As such, stressed reference pixels 90A may exhibit electrical characteristics of burn-in related aging as well as reduced luminance output as the stressed reference pixels 90A are stressed more and more during the life of the display panel 40. For comparison, non-stressed reference pixels 90B may be left off or undergo very little activation during the life of the display panel 40. During sensing, a comparison may be made between the stressed reference pixels 90A and the non-stressed reference pixels 90B. Any suitable number of reference pixels 90 may be used to determine the panel-specific aging profile 82. For example, the display panel 40 may include 10, 100, 200, 300, 1000, or more reference pixels 90. As should be understood, each reference pixel 90 may include multiple sub-pixels (e.g., a red sub-pixel, a green sub-pixel, and a blue sub-pixel). Moreover, although discussed herein as relating to pixels, the profiles and mappings of the present disclosure may include sub-profiles or sub-mappings, respectively, for each color component and may be applied on a sub-pixel basis. In some embodiments, the stressed reference pixels 90A and non-stressed reference pixels 90B may alternate along a row of reference pixels 90 or be patterned/grouped. Furthermore, in some embodiments, each of the stressed reference pixels 90A may be stressed the same amount or stressed differently in groups. For example, groups of stressed reference pixels 90A may be stressed at different rates to maintain reference data points at lower burn-in related age levels as the temporal age of the display panel 40 increases.

As discussed herein, stressing and/or sensing (e.g., for measuring burn-in) of the reference pixels 90 may occur during the life of the display panel 40. In some embodiments, the stressed reference pixels 90A may be stressed during one or more stress sessions periodically and/or in response to certain conditions. For example, a stress session may be initiated (e.g., via the BIC/BIS block 50) to maintain at least a portion of the stressed reference pixels 90A as aged as the most aged pixel of the active area 92. As such, the panel-specific aging profile 82 may be applicable for each pixel of the active area 92. However, if pixels of the active area 92 do exceed the burn-in age of the stressed reference pixels 90A, a predefined aging profile or estimated extension of the panel-specific aging profile 82 may be used. Further, for electronic devices 10 utilizing a battery, stressing and/or sensing of the reference pixels 90A may take place while the electronic device 10 is connected to external power (e.g., during charging), to avoid impacts on power consumption. As should be appreciated different modes of operation of the electronic device 10 may enable or disable stressing and sensing of the reference pixels 90.

Additionally, during stressing and/or sensing, the reference pixels 90 may emit light that does not correspond to a desired image to be displayed. As such, in some embodiments, the reference pixels 90 may be hidden from view. For example, the reference pixels 90 may be disposed behind/beneath a border 94 (e.g., mask) of the electronic display 12 and/or disposed internal to the enclosure 30 such that the emitted light is not visible outside of the enclosure 30.

The reference pixels 90 may be driven by drive circuitry 96, which may be standalone circuitry or implemented as part of the drive circuitry for pixels of the active area 92. Furthermore, sense circuitry 98 may measure the electrical properties of the reference pixels 90 during sensing to help determine how the stressed reference pixels 90A have aged in response to the applied stresses. Additionally or alternatively to the sense circuitry 98, and as discussed further below, the burn-in related aging of the reference pixels 90 may also be measured by luminance sensors 100, such as photoresistors, photodiodes, etc., controlled via photosense circuitry 102. In some embodiments, the luminance sensors 100 may be alternatingly disposed on different sides of the reference pixels 90, for example, for spacing and/or to assist in optical isolation between referenced pixels 90 being sensed.

Figure 10:
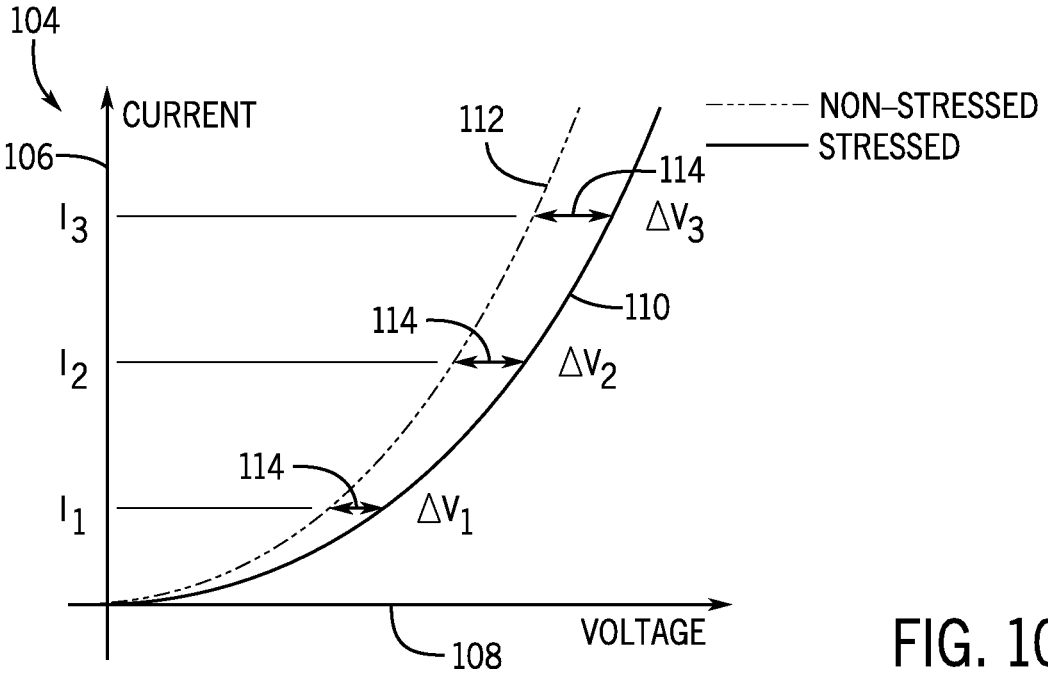
FIG. 10 is a graph of example driving currents and pixel voltages, in accordance with an embodiment.

After stressing the stressed reference pixels 90A, sensing of the reference pixels 90 may be accomplished by driving the stressed reference pixels 90A and the non-stressed reference pixels 90B and measuring their respective responses. For example, FIG. 10 is a graph 104 of drive currents 106 on the y-axis and pixel voltages 108 on the x-axis. In some embodiments, the drive circuitry 96 may provide drive currents 106 to each of the reference pixels 90 at multiple levels (e.g., Ii, 12, and 13) and the pixel voltages 108 may be measured for each of the stressed reference pixels 90A and the non-stressed reference pixels 90B. As the drive current 106 is increased (e.g., in steps or continuously), a stressed curve 110 and a non-stressed curve 112 may be determined. Any suitable number of drive current 106 steps may be used (e.g., 3 steps, 10 steps, 20 steps, 100, steps, etc.) depending on desired granularity and implementation factors. In some embodiments, the pixel voltages 108 of the stressed curve 110 and the non-stressed curve 112 may be calculated as averages, medians, or other measures characteristic of the majority of the stressed reference pixels 90A and the non-stressed reference pixels 90B, respectively.

Figure 11:
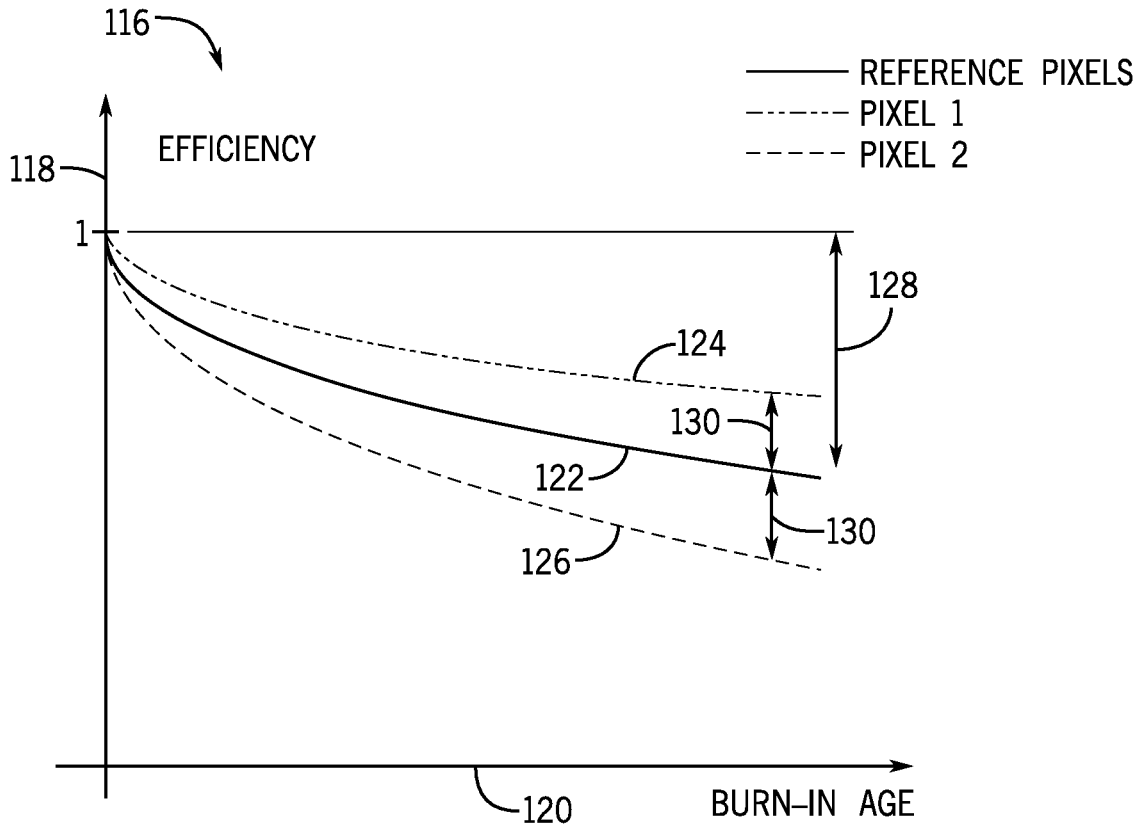
FIG. 11 is a graph of example pixel efficiency and burn-in age, in accordance with an embodiment.

The voltage difference 114 (e.g., $\Delta V_1$, $\Delta V_2$, and $\Delta V_3$) between the stressed curve 110 and the non-stressed curve 112 may correspond to an efficiency drop of the stressed reference pixels 90A associated with their burn-in related age due to the stressing. By stressing the stressed reference pixels 90A to different burn-in ages and measuring the voltage differences 114, the efficiency of the stressed reference pixels 90A may be determined as a function of the burn-in age. FIG. 11 is a graph 116 of the normalized pixel efficiency 118, on the y-axis, and the burn-in age 120, on the x-axis. A reference pixel curve 122 may illustrate the determined pixel efficiencies 118 of the stressed reference pixels 90A based on the measured voltage differences 114 at different burn-in ages 120 (e.g., as stressed over the life of the display panel 40). Because the reference pixels 90 may be representative of the pixels of the display panel 40, the reference pixel curve 122, or other data structure based on the measured voltage differences 114, may represent the panel-specific aging profile 82. Further, combining the panel-specific aging profile 82 with the burn-in history map 80 may generate profiles for other pixels, for example, as illustrated by pixel 1 curve 124 and pixel 2 curve 126. The reference pixel curve 122 has a panel efficiency drop 128 for a given burn-in age 120. Likewise, other pixels may have local efficiency drops 130 relative to the panel efficiency drop 128 due to factors local to those specific pixels such as local temperature during pixel operation and average pixel luminance during pixel operation.

Figure 12:
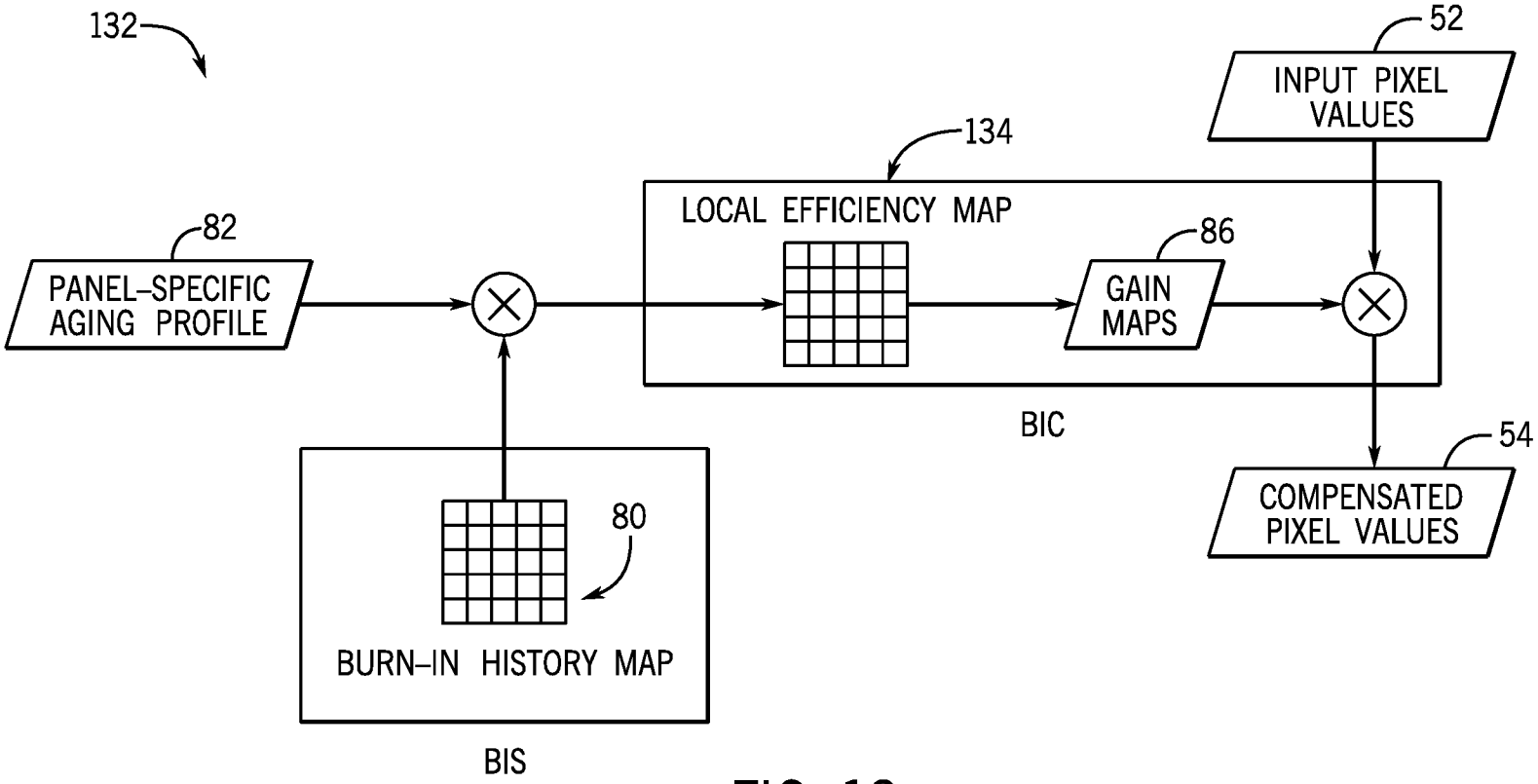
FIG. 12 is a flow diagram of an example process using a panel-specific aging profile to determine compensated pixel values, in accordance with an embodiment.

To help further illustrate, FIG. 12 is a flow diagram 132 of how the panel-specific aging profile 82, generated based on the measured voltage responses of the reference pixels 90, may be used to determine the compensated pixel values 54. For example, the panel-specific aging profile 82 may be combined with the burn-in history map 80, maintained based on BIS history updates 78 of pixels within the active area 92, to generate the local efficiency map 134. The local efficiency map 134 may correspond to the local efficiency drops 130 for the pixels of the entire active area 92. The local efficiency map 134 may be used to generate one or more gain maps 86 that may be combined with the input pixel values 52 to generate the compensated pixel values 54.

Returning to FIG. 9, additionally or alternatively to the sense circuitry 98, the burn-in related aging of the reference pixels 90 may also be measured by luminance sensors 100, such as photoresistors (e.g., thin-film transistors without gates), photodiodes, etc., controlled via photosense circuitry 102. For example, during sensing, the drive currents 106 may be applied to the reference pixels 90 and the reference pixels 90 emit light corresponding thereto. The luminance sensors 100 may sense the luminance output of the reference pixels 90, and a voltage indicative thereof may be measured via the photosense circuitry 102.

Similar to the graph 104 where the voltage differences 114 between the stressed curve 110 and the non-stressed curve 112 are determined, the luminance differences between the stressed reference pixels 90A and the non-stressed reference pixels 90B may be indicative of the burn-in related aging of the stressed reference pixels 90A. In some embodiments, the luminance differences between the stressed reference pixels 90A and the non-stressed reference pixels 90B may be used to generate a panel-specific luminance profile, which, when combined with the burn-in history map 80 may be used to generate a local luminance map. The local luminance map may represent the deviations in luminance for pixels of the active area 92 due to burn-in related aging for given applied signals. As such, gain maps 86 may be generated to compensate the input pixel values 52 for the deviations in luminance.

The local luminance map may be used in conjunction with or instead of the local efficiency map 134. Moreover, in some embodiments, the panel-specific luminance profile may be combined with or supplant the panel-specific aging profile 82, such that the local efficiency map 134 is based, at least in part, on the panel-specific luminance profile. For example, the panel-specific luminance profile and the panel-specific aging profile 82 may be averaged to form a panel-specific combined profile used to generate the local efficiency map 134.

Figure 13:
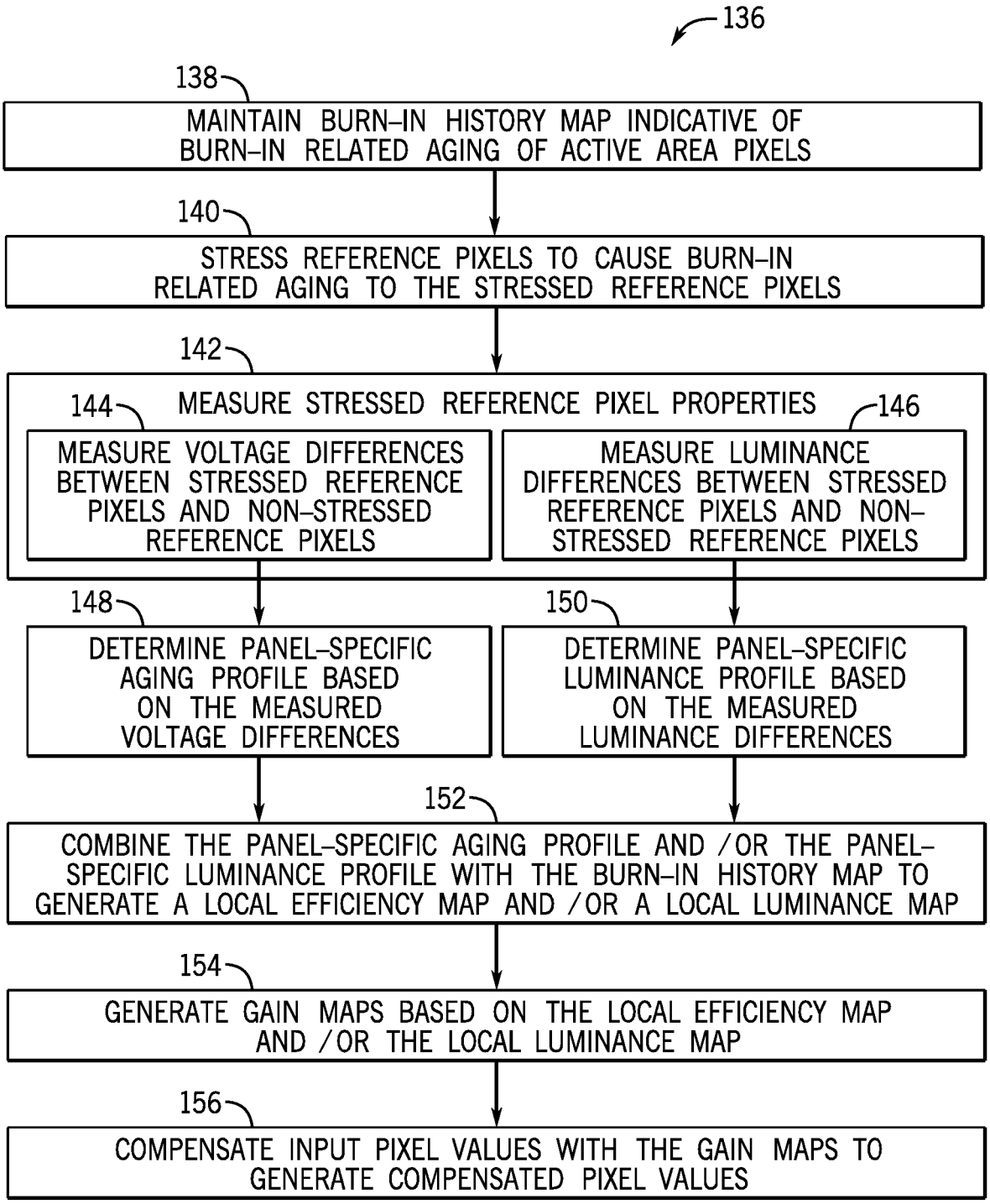
FIG. 13 is a flowchart of an example process for compensating input pixel values for potential burn-in related aging effects, in accordance with an embodiment.

FIG. 13 is a flowchart 136 of an example process for compensating input pixel values 52 for potential burn-in related aging effects. The BIC/BIS block 50 may maintain a burn-in history map 80 indicative of burn-in related aging of pixels in the active area 92 of a display panel 40 (process block 138). As should be appreciated, the burn-in history map 80 may be continuously updated throughout the life of the display panel 40 in response to pixel usage. Additionally, reference pixels 90 may be maintained and analyzed to determine panel-specific aging of the pixels of the active area 92. For example, some reference pixels 90 (e.g., stressed reference pixels 90A) may be stressed to cause burn-in related aging to the stressed reference pixels 90A (process block 140). The properties of the stressed reference pixels 90A may then be measured (process block 142). As should be appreciated, multiple measurements may be taken at various stress levels (e.g., burn-in related ages) of the stressed reference pixels 90A.

Measuring the properties of the stressed reference pixels 90A may include measuring voltage differences 114 between stressed reference pixels 90A and non-stressed reference pixels 90B (process block 144), for example, in response to multiple different driving currents 106. Additionally or alternatively, measuring the properties of the stressed reference pixels 90A may include measuring luminance differences between stressed reference pixels 90A and non-stressed reference pixels 90B (process block 146), for example, in response to multiple different driving currents 106. The measured voltage differences 114 may be used to determine a panel-specific aging profile 82 (process block 148). Similarly, the measured luminance differences may be used to determine a panel-specific luminance profile (process block 150). The panel-specific aging profile 82 and/or the panel-specific luminance profile may be combined with the burn-in history map 80 to generate a local efficiency map 134 and/or a local luminance map (process block 152). In some embodiments, the panel-specific aging profile 82 and the panel-specific luminance profile may be merged and used to generate the local efficiency map 134. Further, in some embodiments, the local luminance map may be generated based on the panel-specific luminance profile and used in conjunction with or merged with the local efficiency map 134. Gain maps 86 may be generated based on the local efficiency map 134 and/or the local luminance map (process block 154), and the input pixel values 52 may be compensated, via the gain maps 86, to generate the compensated pixel values 54 (process block 156).

By compiling and storing the burn-in history map 80 and augmenting it using the panel-specific aging profile 82 and/or the panel-specific luminance profile, gain maps 86 may be determined that counteract the effects of the non-uniform pixel aging. By applying the gains of the gain maps 86 to the input pixel values 52 before they are provided to the electronic display 12, burn-in artifacts that might have otherwise appeared on the electronic display 12 may be reduced or eliminated in advance. Thereby, the burn-in compensation of this disclosure may provide a vastly improved user experience while efficiently using resources of the electronic device 10.

Although the above referenced flowcharts 58 and 136 are shown in a given order, in certain embodiments, process blocks may be reordered, altered, merged, deleted, and/or occur simultaneously. Additionally, the referenced flowcharts 58 and 136 are given as illustrative tools and further decision and process blocks may also be added depending on implementation.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic device comprising:

an electronic display comprising:

a plurality of display pixels disposed in a display area of the electronic display and configured to display an image based at least in part on compensated image data;

a stressed reference pixel disposed outside the display area and configured to exhibit burn-in related aging in response to one or more stress sessions; and a non-stressed reference pixel, separate from the stressed reference pixel, configured to not undergo the one or more stress sessions; and image processing circuitry configured to:

determine a panel-specific aging profile based at least in part on a comparison between one or more properties of the stressed reference pixel and the one or more properties of the non-stressed reference pixel;

maintain a burn-in history map corresponding to estimated burn-in ages of the plurality of display pixels;

determine a local efficiency map based at least in part on the burn-in history map and the panel-specific aging profile;

generate one or more gain maps based at least in part on the local efficiency map; and generate the compensated image data by applying the one or more gain maps to input image data.

2. The electronic device of claim 1, wherein the one or more properties comprises a pixel voltage, wherein the panel-specific aging profile is based at least in part on a voltage difference between the pixel voltage of the stressed reference pixel and the pixel voltage of the non-stressed reference pixel.

3. The electronic device of claim 1, wherein the one or more properties comprises a pixel luminance, wherein the panel-specific aging profile is based at least in part on a luminance difference between the pixel luminance of the stressed reference pixel and the pixel luminance of the non-stressed reference pixel.

4. The electronic device of claim 3, comprising a plurality of luminance sensors configured to measure the pixel luminance of the stressed reference pixel and the pixel luminance of the non-stressed reference pixel.

5. The electronic device of claim 1, wherein the one or more stress sessions comprise enabling the stressed reference pixel to a maximum brightness for one or more respective periods of time such that the burn-in related aging of the stressed reference pixel is greater than a greatest burn-in related age of the plurality of display pixels.

6. The electronic device of claim 1, comprising a battery configured to operatively supply power to the electronic device, wherein the one or more stress sessions are configured to occur during charging of the battery.

7. The electronic device of claim 1, wherein the electronic display comprises a border that optically hides the stressed reference pixel and the non-stressed reference pixel from view.

8. The electronic device of claim 1, comprising drive circuitry dedicated to drive the stressed reference pixel and the non-stressed reference pixel.

9. A method comprising:

maintaining a burn-in history map associated with burn-in related aging of display pixels of a display panel;

stressing a first reference pixel to cause the burn-in related aging to the first reference pixel;

measuring a property of the first reference pixel in response to a drive current;

measuring the property of a second reference pixel in response to the drive current, wherein the second reference pixel comprises a non-stressed reference pixel separate from the first reference pixel;

determining a panel-specific aging profile based on a comparison between the measured property of the first reference pixel and the measured property of the second reference pixel;

combining the panel-specific aging profile with the burn-in history map to generate a local luminance map, wherein the local luminance map comprises respective pixel luminance deviations, due to the burn-in related aging, of respective pixels of the display pixels;

generating one or more gain maps based at least in part on the local luminance map; and compensating image data for the burn-in related aging of the display pixels based at least in part on the one or more gain maps.

10. The method of claim 9, wherein the property comprises a pixel voltage.

11. The method of claim 9, wherein the property comprises a pixel luminance.

12. The method of claim 9, wherein the property of the first reference pixel comprises directly measuring, via one or more luminance sensors, a luminance output of the first reference pixel at the drive current.

13. The method of claim 12, comprising:

changing the drive current to a second drive current; and directly measuring, via the one or more luminance sensors, the luminance output of the first reference pixel at the second drive current.

14. The method of claim 13, wherein the panel-specific aging profile is based at least in part on the luminance output of the first reference pixel at the drive current and the luminance output of the first reference pixel at the second drive current.

15. Image processing circuitry configured to:

determine a panel-specific aging profile based at least in part on a voltage difference between a first measured voltage of a first reference pixel and a second measured voltage of a second reference pixel, wherein the first reference pixel has been intentionally stressed to exhibit burn-in related aging, wherein the second reference pixel comprises a non-stressed reference pixel separate from the first reference pixel, wherein the panel-specific aging profile corresponds to a measured efficiency drop of the first reference pixel due at least in part to the burn-in related aging;

generate a local efficiency map based at least in part on the panel-specific aging profile and a burn-in history map corresponding to estimated burn-in related aging of a plurality of display pixels configured to display image content based at least in part on image data, wherein the local efficiency map comprises respective pixel efficiency drops, due to the burn-in related aging, of respective pixels of the display pixels;

generate one or more gain maps based at least in part on the local efficiency map; and apply the one or more gain maps to the image data to compensate for the estimated burn-in related aging of the display pixels.

16. The image processing circuitry of claim 15, wherein the image processing circuitry is configured to determine the panel-specific aging profile based on a luminance difference between a first measured luminance of the first reference pixel and a second measured luminance of the second reference pixel.

17. The image processing circuitry of claim 15, wherein the panel-specific aging profile is based at least in part on a plurality of voltage differences between the first reference pixel and the second reference pixel in response to a corresponding plurality of driving currents.

18. The image processing circuitry of claim 15, wherein the panel-specific aging profile is based at least in part on a plurality of voltage differences between the first reference pixel and the second reference pixel corresponding to a plurality of different stress levels of the first reference pixel.

* * * * *